US006082157A

United States Patent [19]

Boyce

[11] Patent Number: 6,082,157

[45] Date of Patent: Jul. 4, 2000

[54] COMBINATION SAFE AND UMBRELLA STAND

[76] Inventor: Stuart T. Boyce, 88 Hazelwood Lane, Palmers Green, London, United Kingdom, N13 5HB

[21] Appl. No.: 09/271,849

[22] Filed: Mar. 18, 1999

[51] Int. Cl.[7] ..... E05B 73/00

[52] U.S. Cl. ..... 70/58; 70/63; 70/164; 135/118; 248/530; 248/552; 109/23; 109/50

[58] Field of Search ..... 70/57, 63, 164, 70/58, 59, 62; 109/23, 50–52; 248/551–553, 156, 910, 530; 135/16, 118; 52/155, 159; 220/315, 328, 521

[56] References Cited

U.S. PATENT DOCUMENTS

| | | | |
|---|---|---|---|
| 1,778,502 | 10/1930 | Levey | 70/164 |
| 1,838,653 | 12/1931 | Bergman | 248/295.11 X |
| 1,898,946 | 2/1933 | Fitzgerald | 248/125.1 |
| 2,010,877 | 8/1935 | Morell | 109/51 |
| 2,180,117 | 11/1939 | Lipsis | 109/51 |
| 2,607,553 | 8/1952 | Garrett | 248/295.11 X |
| 2,755,748 | 7/1956 | Abell, Jr. | 70/63 X |
| 3,036,758 | 5/1962 | Greenbank et al. | 70/63 X |
| 3,710,736 | 1/1973 | Biondi et al. | 109/52 X |
| 4,664,041 | 5/1987 | Wood | 109/51 |
| 5,199,361 | 4/1993 | Robinson | 248/551 X |
| 5,235,920 | 8/1993 | Hector | 70/63 X |
| 5,299,721 | 4/1994 | Cummings | 70/164 X |

FOREIGN PATENT DOCUMENTS

| | | | |
|---|---|---|---|
| 90675 | 10/1983 | European Pat. Off. | 109/51 |
| 961575 | 6/1964 | United Kingdom | 109/23 |
| 2181781 | 4/1987 | United Kingdom | 70/63 |

*Primary Examiner*—Lloyd A. Gall

[57] ABSTRACT

A combination safe and umbrella stand for securely storing valuables and other items therein and vertically supporting a beach umbrella. The combination safe and umbrella stand includes a container with a top opening therein. A lid substantially closes the top opening of the container. A rod is extended through the holes in the lid and container to prevent removal of the lid from the container without removal of the rod. One of the ends of the rod has a stop coupled thereto. The rod has a transverse bore therethrough adjacent the other of the ends of the rod. An auger is downwardly extended from the bottom wall of the container. A pair of spaced apart brackets for supporting a pole of an umbrella are outwardly extended from the perimeter side wall of the container.

9 Claims, 2 Drawing Sheets

COMBINATION SAFE AND UMBRELLA STAND

BACKGROUND OF THE INVENTION

1. Field of the Invention

The present invention relates to beach accessories and portable safes and more particularly pertains to a new combination safe and umbrella stand for securely storing valuables and other items therein and vertically supporting a beach umbrella.

2. Description of the Prior Art

The use of beach accessories and portable safes is known in the prior art. More specifically, beach accessories and portable safes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,051,790 by Meditz et al.; U.S. Pat. No. 4,029,370 by Ziegel et al.; U.S. Pat. No. 4,098,199 by Haje; U.S. Pat. No. 4,452,390 by West; U.S. Pat. No. 4,667,491 by Lokken et al.; and U.S. Pat. No. Des. 325,282 by Scalfe.

While these devices fulfill their respective, particular objectives and requirements, the aforementioned patents do not disclose a new combination safe and umbrella stand. The inventive device includes a container with a top opening therein. A lid substantially closes the top opening of the container. A rod is extended through the holes in the lid and container to prevent removal of the lid from the container without removal of the rod. One of the ends of the rod has a stop coupled thereto. The rod has a transverse bore therethrough adjacent the other of the ends of the rod. An auger is downwardly extended from the bottom wall of the container. A pair of spaced apart brackets for supporting a pole of an umbrella are outwardly extended from the perimeter side wall of the container.

In these respects, the combination safe and umbrella stand according to the present invention substantially departs from the conventional concepts and designs of the prior art, and in so doing provides an apparatus primarily developed for the purpose of securely storing valuables and other items therein and vertically supporting a beach umbrella.

SUMMARY OF THE INVENTION

In view of the foregoing disadvantages inherent in the known types of beach accessories and portable safes now present in the prior art, the present invention provides a new combination safe and umbrella stand construction wherein the same can be utilized for securely storing valuables and other items therein and vertically supporting a beach umbrella.

The general purpose of the present invention, which will be described subsequently in greater detail, is to provide a new combination safe and umbrella stand apparatus and method which has many of the advantages of the beach accessories and portable safes mentioned heretofore and many novel features that result in a new combination safe and umbrella stand which is not anticipated, rendered obvious, suggested, or even implied by any of the prior art beach accessories and portable safes, either alone or in any combination thereof.

To attain this, the present invention generally comprises a container with a top opening therein. A lid substantially closes the top opening of the container. A rod is extended through the holes in the lid and container to prevent removal of the lid from the container without removal of the rod. One of the ends of the rod has a stop coupled thereto. The rod has a transverse bore therethrough adjacent the other of the ends of the rod. An auger is downwardly extended from the bottom wall of the container. A pair of spaced apart brackets for supporting a pole of an umbrella are outwardly extended from the perimeter side wall of the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination safe and umbrella stand apparatus and method which has many of the advantages of the beach accessories and portable safes mentioned heretofore and many novel features that result in a new combination safe and umbrella stand which is not anticipated, rendered obvious, suggested, or even implied by any of the prior art beach accessories and portable safes, either alone or in any combination thereof.

It is another object of the present invention to provide a new combination safe and umbrella stand which may be easily and efficiently manufactured and marketed.

It is a further object of the present invention to provide a new combination safe and umbrella stand which is of a durable and reliable construction.

An even further object of the present invention is to provide a new combination safe and umbrella stand which is susceptible of a low cost of manufacture with regard to both materials and labor, and which accordingly is then susceptible of low prices of sale to the consuming public, thereby making such combination safe and umbrella stand economically available to the buying public.

Still yet another object of the present invention is to provide a new combination safe and umbrella stand which provides in the apparatuses and methods of the prior art some of the advantages thereof, while simultaneously overcoming some of the disadvantages normally associated therewith.

Still another object of the present invention is to provide a new combination safe and umbrella stand for securely storing valuables and other items therein and vertically supporting a beach umbrella.

Yet another object of the present invention is to provide a new combination safe and umbrella stand which includes a container with a top opening therein. A lid substantially closes the top opening of the container. A rod is extended through the holes in the lid and container to prevent removal of the lid from the container without removal of the rod. One of the ends of the rod has a stop coupled thereto. The rod has a transverse bore therethrough adjacent the other of the ends of the rod. An auger is downwardly extended from the bottom wall of the container. A pair of spaced apart brackets for supporting a pole of an umbrella are outwardly extended from the perimeter side wall of the container.

Still yet another object of the present invention is to provide a new combination safe and umbrella stand that may also be used as a cooler to hold beverages and food items therein.

Even still another object of the present invention is to provide a new combination safe and umbrella stand that allows users to keep valuables stored in a secured location when at the beach.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
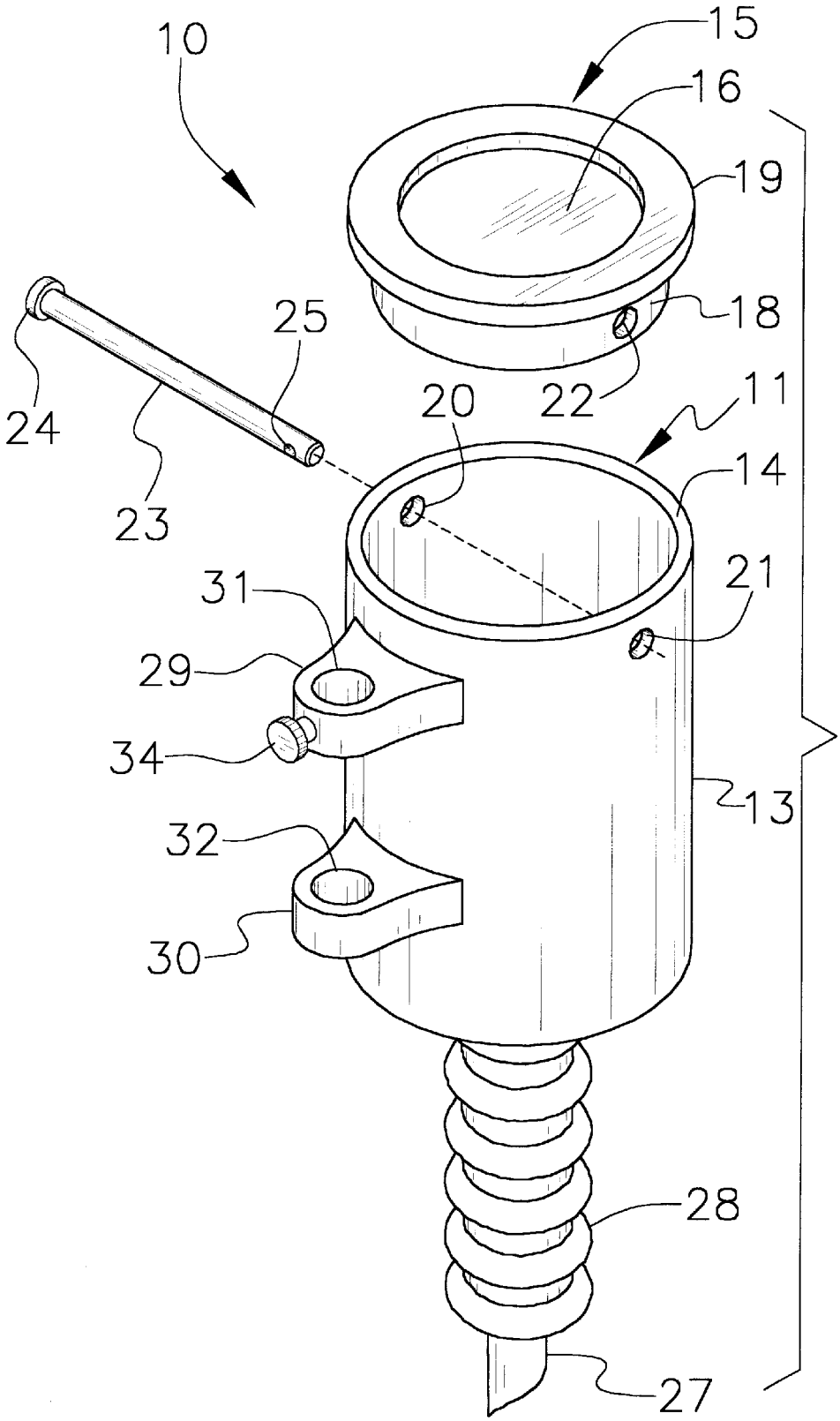
FIG. 1 is a schematic exploded perspective view of a new combination safe and umbrella stand according to the present invention.
Figure 2:
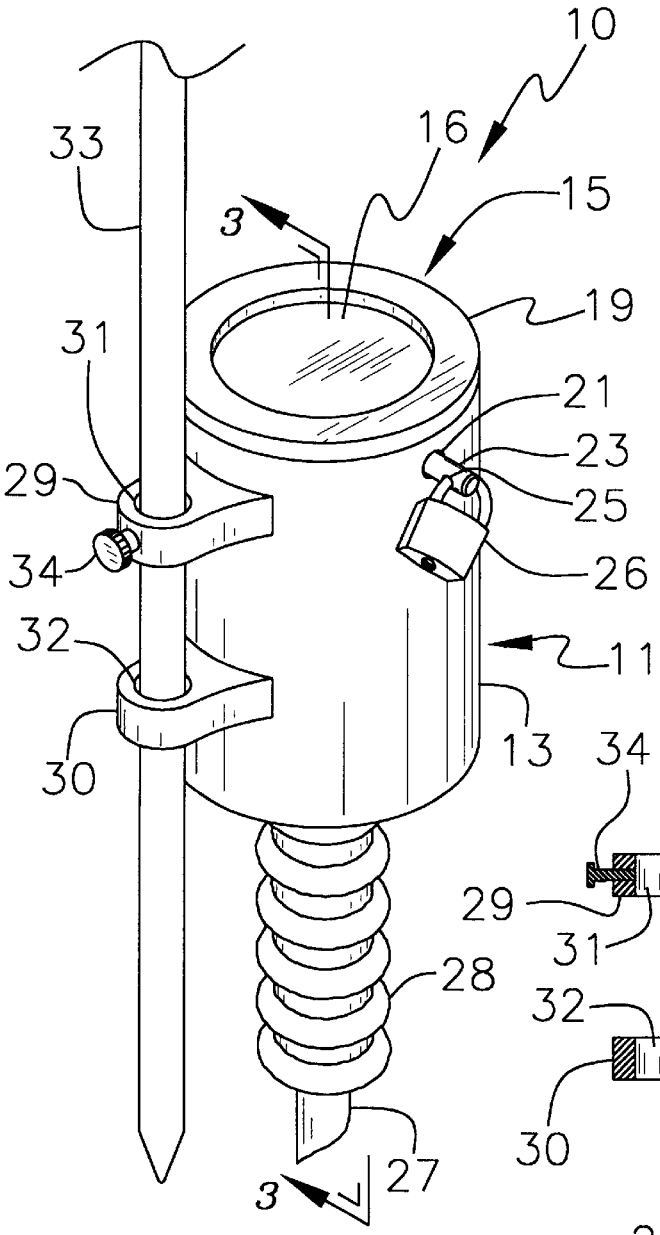
FIG. 2 is a schematic perspective view of the present invention.
Figure 3:
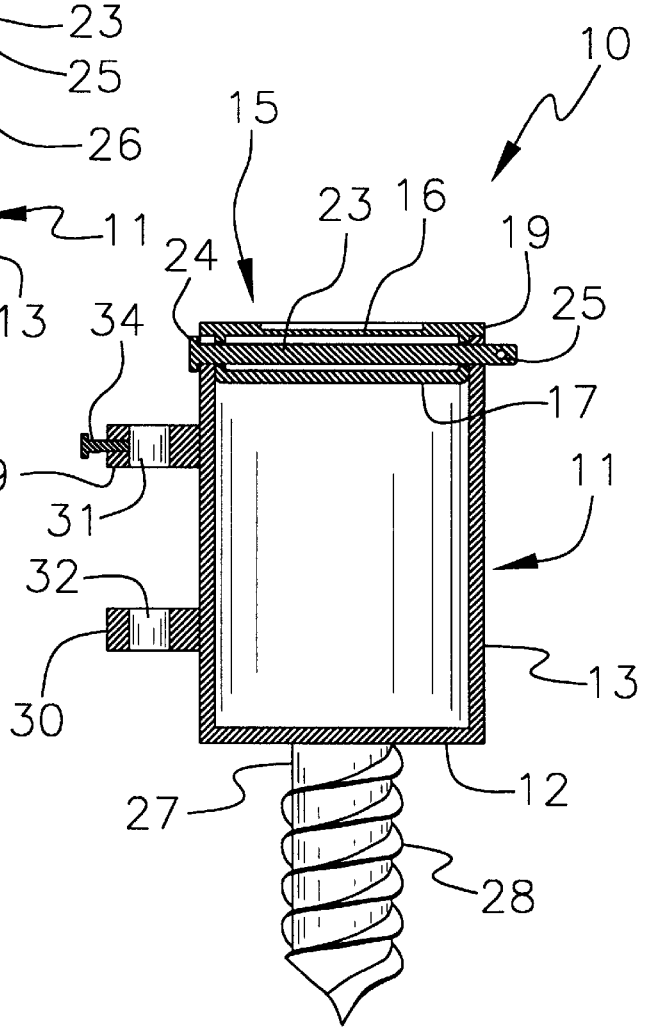
FIG. 3 is a schematic cross sectional view of the present invention taken from line 3—3 of FIG. 2.

With reference now to the drawings, and in particular to FIGS. 1 through 3 thereof, a new combination safe and umbrella stand embodying the principles and concepts of the present invention and generally designated by the reference numeral 10 will be described.

As best illustrated in FIGS. 1 through 3, the combination safe and umbrella stand 10 generally comprises a container with a top opening therein. A lid substantially closes the top opening of the container. A rod is extended through the holes in the lid and container to prevent removal of the lid from the container without removal of the rod. One of the ends of the rod has a stop coupled thereto. The rod has a transverse bore therethrough adjacent the other of the ends of the rod. An auger is downwardly extended from the bottom wall of the container. A pair of spaced apart brackets for supporting a pole of an umbrella are outwardly extended from the perimeter side wall of the container.

In use, the combination safe and umbrella stand 10 is an apparatus designed for holding items therein and supporting an umbrella upwardly extending from a ground surface. In closer detail, the combination safe and umbrella stand comprises a generally cylindrical container 11 having a generally circular bottom wall 12 and a generally cylindrical perimeter side wall 13 upwardly extending around the bottom wall of the container. The perimeter side wall of the container has an annular upper edge 14 defining a top opening into the container. Preferably, the upper edge of the perimeter side wall and the bottom wall of the container lie in generally parallel planes to one another. In use, the container is designed for holding valuables and other items therein. Optionally, the bottom wall and the perimeter side wall each may be constructed to have an insulated interior layer so that the container may be used as a cooler to help keep beverages and foodstuffs in the container cool. The container has a height defined between the upper edge of the perimeter side wall and the bottom wall of the container while the perimeter side wall of the container defines an outer diameter of the container. In an ideal illustrative embodiment, the height of the container is about 12 inches, and the outer diameter of the container is about 9 inches.

A generally disk-shaped lid 15 is inserted into the top opening of the container to substantially close the top opening of the container. The lid has generally circular upper and lower faces 16,17, and a generally cylindrical outer side 18 between the upper and lower faces of the lid. Optionally, the outer side of the lid may frictionally engage an annular portion of an inner surface of the perimeter side wall of the container to help hold the lid to the container so that the lid is only removable from the container by a user pulling on the lid with sufficient force to exceed the frictional contact between the lid and the container.

Preferably, the lid has an annular lip 19 outwardly radiating around the upper face of the lid. The lip of the lid is rested on the upper edge of the perimeter side wall of the container. The lip of the lid defines a generally circular central depression in the upper face of the lid. In use, the central depression of the upper face of the lid is designed for resting items therein with the lip helping to prevent the items from sliding off of the upper face of the lid.

The perimeter side wall of the container has a pair generally circular holes 20,21 therethrough adjacent the upper edge of the perimeter side wall. The holes of the perimeter side wall are generally diametrically located on the perimeter side wall and generally coaxial with one another. Similarly, the outer side of the lid has a pair of coaxial and generally diametrically located holes 22 therethrough. The lid is positioned on the container so that the holes of the outer side of the lid and the holes of the perimeter side wall of the container are generally coaxially aligned with one another.

A generally cylindrical elongate rod 23 is extended through the holes of the outer side of the lid and the holes of the perimeter side wall of the container. In use, the rod prevents lifting of the lid off of the container without removal of the rod. The rod has a pair of opposite ends and a longitudinal axis extending between the ends of the rod. The ends of the rod are outwardly extended in opposite directions from the perimeter side wall of the container as illustrated in FIGS. 2 and 3.

One of the ends of the rod has a generally disk shaped stop 24 coupled thereto. The stop has a diameter greater than the adjacent hole of the perimeter side wall of the container to prevent sliding of the stop through the hole of the perimeter side wall. The rod has a transverse bore 25 therethrough adjacent the other of the ends of the rod. Preferably, the transverse bore of the rod has an axis extending substantially perpendicular to the longitudinal axis of the rod. A lock 26, such as a padlock, is extended through the transverse bore of the rod to prevent removal of the rod from the holes of the outer side of the lid and the holes of the perimeter side wall of the container.

An auger 27 is downwardly extended from a central region of the bottom wall of the container. The auger has a spiraling thread 28 therearound designed for rotatably inserting the auger into a ground surface such as a sandy beach auger from removal of the auger from the ground surface without rotation in an opposite direction of the auger. In an ideal illustrative embodiment, the auger has a length defined downwardly from the bottom wall of the container of about 24 inches.

A pair of spaced apart brackets 29,30 are outwardly extended from the perimeter side wall of the container with one of the brackets positioned above the other bracket. Each of the brackets has a bore 31,32 extending therethrough. The bores of the brackets are generally coaxial with one another along an axis extending generally parallel to the perimeter side wall. In an ideal illustrative embodiment, the bores of the brackets each have a diameter of about 1 inch. In use, as illustrated in FIG. 2, the bores of the brackets are designed for extending a pole 33 of a beach umbrella therethrough to support the umbrella above the ground surface in which the auger is inserted. One of the brackets has a set screw 34 threadably inserted into the bore of the respective bracket. In use, the set screw is designed for holding the pole of the umbrella in position in the bore of the bracket.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus, comprising:

a container having a bottom wall and a perimeter side wall upwardly extending around said bottom wall of said container;

said perimeter side wall of said container having an upper edge defining a top opening into said container;

a lid being inserted into said top opening of said container to substantially close said top opening of said container;

said lid having generally upper and lower faces, and an outer side between said upper and lower faces of said lid;

said perimeter side wall of said container having a pair of generally circular holes therethrough adjacent said upper edge of said perimeter side wall;

said outer side of said lid having a pair of holes therethrough;

an elongate rod being extended through said holes of said outer side of said lid and said holes of said perimeter side wall of said container;

said rod having a pair of opposite ends and a longitudinal axis extending between said ends of said rod;

said ends of said rod being outwardly extended in opposite directions from said perimeter side wall of said container;

one of said ends of said rod having a generally disk shaped stop coupled thereto;

said rod having a transverse bore therethrough adjacent the other of said ends of said rod;

an auger being downwardly extended from said bottom wall of said container;

a pair of spaced apart brackets being outwardly extended from said perimeter side wall of said container;

each of said brackets having a bore extending therethrough; and wherein said lid has a lip outwardly radiating around said upper face of said lid, said lip of said lid being rested on said upper edge of said perimeter side wall of said container, wherein said lip of said lid. defines a central depression in said upper face of said lid, said central depression of said upper face of said lid being adapted for resting items therein with the lip helping to prevent the items from sliding off of the upper face of the lid.

2. The apparatus of claim 1, wherein said upper edge of said perimeter side wall and said bottom wall of said container lie in generally parallel planes to one another.

3. The apparatus of claim 1, wherein said holes of said perimeter side wall are generally diametrically located on said perimeter side wall and generally coaxial with one another, wherein said holes of said outer side of said lid are generally diametrically located on said outer side and generally coaxial with one another, and wherein said holes of said outer side of said lid and said holes of said perimeter side wall of said container are generally coaxially aligned with one another.

4. The apparatus of claim 1, wherein said stop has a diameter greater than the adjacent hole of said perimeter side wall of said container to prevent sliding of said stop through said hole of said perimeter side wall.

5. The apparatus of claim 1, wherein said transverse bore of said rod has an axis extending substantially perpendicular to said longitudinal axis of said rod.

6. The apparatus of claim 1, further comprising a lock being extended through said transverse bore of said rod to prevent removal of said rod from said holes of said outer side of said lid and said holes of said perimeter side wall of said container.

7. The apparatus of claim 1, wherein said bores of said brackets are generally coaxial with one another.

8. The apparatus of claim 1, wherein one of said brackets has a set screw threadably inserted into said bore of the respective bracket.

9. An apparatus for holding items therein and supporting an umbrella upwardly extending from a ground surface, said apparatus comprising: p1 a container being generally cylindrical and having a generally circular bottom wall and a generally cylindrical perimeter side wall upwardly extending around said bottom wall of said container;

said perimeter side wall of said container having an annular upper edge defining a top opening into said container;

said upper edge of said perimeter side wall and said bottom wall of said container lying in generally parallel planes to one another;

said container being adapted for holding valuables and other items therein, wherein said bottom wall and said perimeter side wall each have an insulated interior layer so that the container may be used as a cooler to help keep beverages and foodstuffs in the container cool;

said container having a height defined between said upper edge of said perimeter side wall and said bottom wall of said container, said perimeter side wall of said container defining an outer diameter of said container;

wherein said height of said container is about 12 inches, and said outer diameter of said container is about 9 inches;

a generally disk-shaped lid substantially being inserted into said top opening of said container to substantially close said top opening of said container;

said lid having generally circular upper and lower faces, and a generally cylindrical outer side between said upper and lower faces of said lid;

said outer side of said lid frictionally engaging an annular portion of an inner surface of said perimeter side wall of said container to help hold said lid to said container so that said lid is only removable from the container by a user pulling on the lid with sufficient force to exceed the frictional contact between the lid and the container;

said lid having an annular lip outwardly radiating around said upper face of said lid, said lip of said lid being rested on said upper edge of said perimeter side wall of said container;

said lip of said lid defining a generally circular central depression in said upper face of said lid, said central depression of said upper face of said lid being adapted for resting items therein with the lip helping to prevent the items from sliding off of the upper face of the lid;

said perimeter side wall of said container having a pair of generally circular holes therethrough adjacent said upper edge of said perimeter side wall;

said holes of said perimeter side wall being generally diametrically located on said perimeter side wall and generally coaxial with one another;

said outer side of said lid having a pair of coaxial and generally diametrically located holes therethrough;

said holes of said outer side of said lid and said holes of said perimeter side wall of said container being generally coaxially aligned with one another;

an elongate rod being extended through said holes of said outer side of said lid and said holes of said perimeter side wall of said container;

said rod preventing lifting of said lid off of said container without removal of said rod;

said rod having a pair of opposite ends and a longitudinal axis extending between said ends of said rod;

said ends of said rod being outwardly extended in opposite directions from said perimeter side wall of said container;

one of said ends of said rod having a generally disk shaped stop coupled thereto, said stop having a diameter greater than the adjacent hole of said perimeter side wall of said container to prevent sliding of said stop through said hole of said perimeter side wall;

said rod having a transverse bore therethrough adjacent the other of said ends of said rod, said transverse bore of said rod having an axis extending substantially perpendicular to said longitudinal axis of said rod;

a lock being extended through said transverse bore of said rod to prevent removal of said rod from said holes of said outer side of said lid and said holes of said perimeter side wall of said container;

an auger being downwardly extended from a central region of said bottom wall of said container, said auger having a spiraling thread therearound adapted for rotatably inserting said auger into a ground surface to prevent removal of said auger from said ground surface without rotation in an opposite direction of said auger;

said auger having a length defined downwardly from said bottom wall of said container of about 24 inches;

a pair of spaced apart brackets being outwardly extended from said perimeter side wall of said container, one of said brackets being positioned above the other bracket;

each of said brackets having a bore extending therethrough;

said bores of said brackets being generally coaxial with one another along an axis extending generally parallel to said perimeter side wall;

said bores of said brackets each having a diameter of about 1 inch;

said bores of said brackets being adapted for extending a pole of a umbrella therethrough to support said umbrella above the ground surface in which said auger is inserted; and one of said brackets having a set screw threadably inserted into said bore of the respective bracket, said set screw being adapted for holding said pole of said umbrella in position in said bore of said bracket.

* * * * *